US006065767A

United States Patent [19]

Girotto et al.

[11] Patent Number: 6,065,767

[45] Date of Patent: May 23, 2000

[54] LOCKING DEVICE PARTICULARLY FOR SNOWBOARDS

[75] Inventors: Adriano Girotto, Spresiano; Giuliano Giusto, Mogliano Veneto, both of Italy

[73] Assignee: Buckfield Contracting Limited, Douglas, United Kingdom

[21] Appl. No.: 09/254,295

[22] PCT Filed: Aug. 28, 1997

[86] PCT No.: PCT/EP97/04695

§ 371 Date: Mar. 3, 1999

§ 102(e) Date: Mar. 3, 1999

[87] PCT Pub. No.: WO98/09690

PCT Pub. Date: Mar. 12, 1998

[30] Foreign Application Priority Data

Sep. 4, 1996 [IT] Italy ..... TV96A0108

[51] Int. Cl.[7] ..... A63C 9/081

[52] U.S. Cl. ..... 280/607; 280/618; 280/14.2

[58] Field of Search ..... 280/601, 607, 280/617, 618, 624, 625, 14.2, 633, 634, 613; 441/70

[56] References Cited

U.S. PATENT DOCUMENTS

| | | | |
|---|---|---|---|
| 5,299,823 | 4/1994 | Glaser . | |
| 5,765,853 | 6/1998 | Erb | 280/14.2 |
| 5,782,476 | 7/1998 | Fardie | 280/14.2 |
| 5,791,678 | 8/1998 | Perlman | 280/14.2 |
| 5,967,542 | 10/1999 | Williams et al. | 280/14.2 |

FOREIGN PATENT DOCUMENTS

| | | |
|---|---|---|
| 2669237 | 5/1992 | France . |
| 2356052 | 5/1975 | Germany . |

*Primary Examiner*—Richard M. Camby
*Attorney, Agent, or Firm*—Cantor Colburn LLP

[57] ABSTRACT

A locking device particularly for snowboards which comprises a circular plate which is rigidly coupled to a board. The device is constituted by a rotating body which is rotatably associated with the plate and is provided with elements for engaging and temporarily compressing complementarily shaped grip elements associated with the sole of a shoe. There are also provided elements for temporarily locking the rotation of the rotating body.

20 Claims, 9 Drawing Sheets

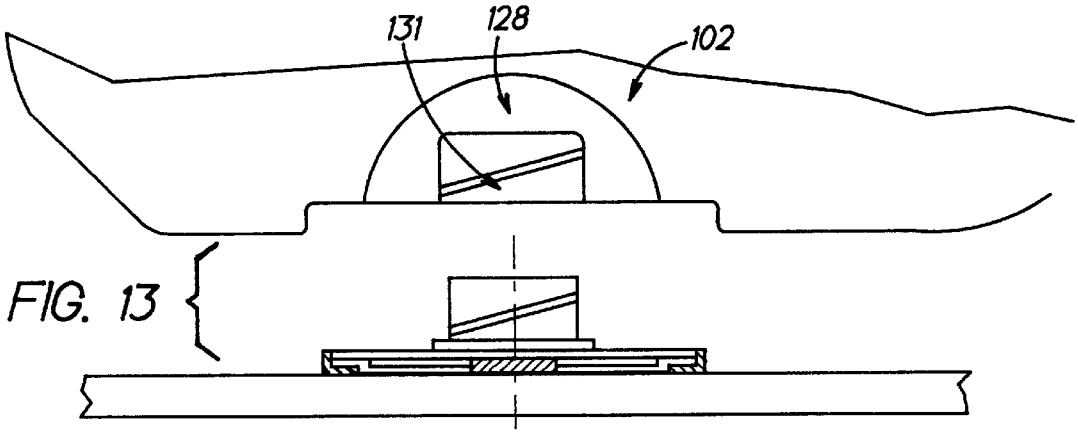
FIG. 13
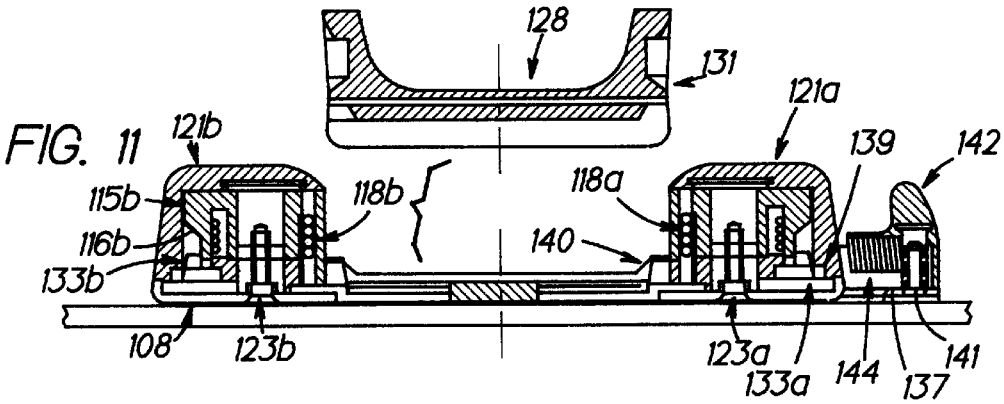
FIG. 11
FIG. 12
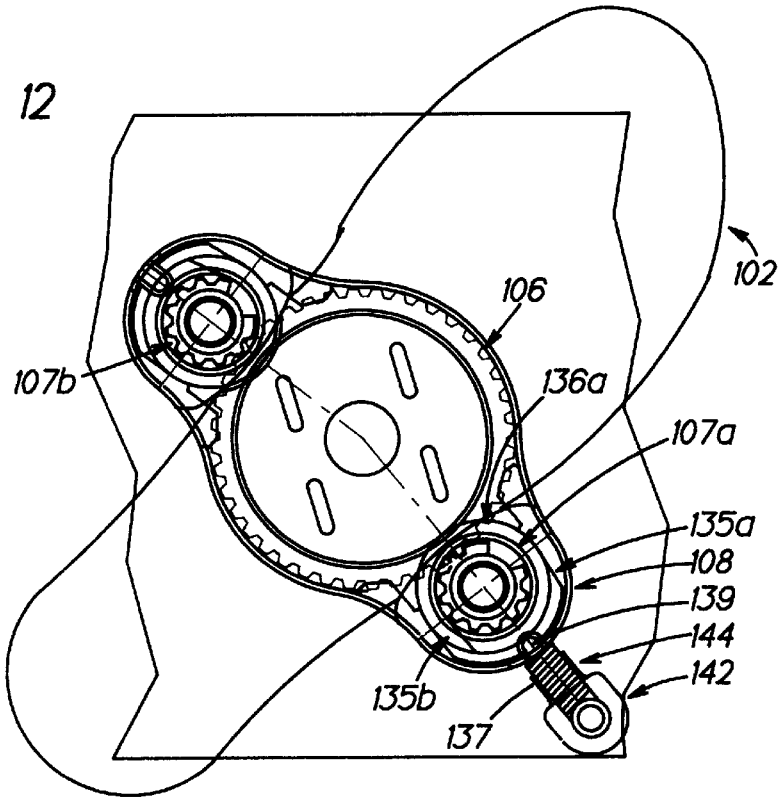

LOCKING DEVICE PARTICULARLY FOR SNOWBOARDS

TECHNICAL FIELD

The present invention relates to a locking device particularly for snowboards.

BACKGROUND ART

Snowboards are constituted by a single board on which shoe bindings must be associated; these bindings usually must allow the skier to achieve a position which is slightly rotated with respect to the longitudinal axis of the board.

The technology used so far to provide ski bindings is not applied directly to the case of snowboards: in this regard, patent DT 23 56 052 discloses a safety ski binding with a plate which can be accommodated on the ski; the shoe is engaged with the tip by means of supporting elements which are fixed on the plate and with the rear part by lateral supporting elements which are fixed to the plate.

This conventional solution entails drawbacks, since it cannot be transferred directly to an application on snowboards, since the user must arrange the shoes at an angle with respect to the longitudinal axis of the board and so as to be able to preset slight rotations of the shoes in order to improve control of the board.

In snowboarding it is also necessary to have perfect adhesion of the shoe or of most of it to the board, since steering is achieved by shifting the weight of the body from one side to the other of the board; in ski bindings of the illustrated kind, instead, layers of snow or ice can form between the skis and the sole of the shoe, consequently worsening the control of the board.

In relation to the specific use of snowboards, French patent no. 2,669,237 discloses an adjustable safety binding for skiing boards, also known as snowboards, which comprises a base which is meant to be fitted to the board and a top part which is connected to detachable shoe locking means; the base comprises a spherical pivot which is complementary to a spherical pivot of the top part, so as to provide a ball-and-socket joint which allows mutual angular adjustment of the base and the top part with three degrees of angular freedom and furthermore provides a means for locking the base and the top part.

In this solution, therefore, an angular adjustment of the position of the shoe with respect to the board is substantially achieved, but the connection and disconnection of the shoe with respect to the binding is not easy, since it is in any case locked by the interaction of means which act on the tip and on the heel unit of the shoe; all this entails difficult transmission of forces from the foot to the board, since these forces must be located in the small area of interaction between the base and the top part, dissipating for example the forces applied during body weight shifting and possibly deforming the components which are mutually rotatably associated.

The use of any flexible elements does not solve the problem, since it leads to an unwanted dissipation of forces and therefore the skier is unable to have good sensitivity on the board, since he cannot directly transmit the forces applied to the shoe.

U.S. Pat. No. 5,299,823 relates to a snowboard binding which comprises a fixed jaw for coupling one side of a shoe and a movable jaw which is fitted so as to engage the opposite side of the shoe.

A lever places the seat for the movable jaw in a locked condition, in which the fitted movable jaw is fixed so as to be in a locked condition with the shoe; in an intermediate condition, in which the seat for the movable jaw can be shifted laterally towards a free condition; and in a released condition, in which the seat for the movable jaw can be either moved safely towards the free condition or can be promptly moved towards the free condition in contrast with a spring.

This solution is structurally complicated and is subject to possible jamming of its components, which are affected by several relative movements in order to lock and/or release the shoe.

All these solutions furthermore have the drawback that they require to place the board on a level surface in order to achieve easier fixing of the shoe, but this is a seldom available condition.

DISCLOSURE OF THE INVENTION

The aim of the present invention is to solve the described problems, eliminating the drawbacks of the cited prior art and thus providing a locking device which is specific for snowboards, is compact and allows to achieve optimum transmission of forces from the shoe to the board, in order to achieve optimum control of said board.

Within the scope of this aim, an important object is to provide a device which allows to minimize the presence of any snow at the sole of the shoe when it is activated and therefore when said shoe is locked.

Another important object of the invention is to provide a device which, despite the possible presence of thin layers of snow or ice between the shoe and the snowboard, allows to achieve the above characteristics even if the snow or ice melts during sports activity.

Another important object of the invention is to provide a device which allows optimum, quick and simple engagement and disengagement of the shoe even if those operations are performed on slopes.

Another important object of the invention is to provide a device which allows to achieve optimum insertion and centering of the shoe therein.

Another object is to provide a device which associates with the preceding characteristics that of being structurally simple as well as reliable and safe in use and of being producible with conventional machines and equipment.

In accordance with the invention as defined in the appended claims, there is provided a locking device for releasably locking a shoe to a snowboard, which comprises a circular plate for being rigidly coupled to a board of a snowboard, a first rotating body which is rotatably associated with the plate about an axis substantially perpendicular to the snowboard and is provided with means for engaging and temporarily compressing complementarily shaped grip means adapted to be associated with a shoe sole, the rotating body being adapted for actuating the engaging and compressing means into a releasable locked position with the grip means when the shoe is placed on the rotating body and rotates it into the locking position, and means are provided for temporarily locking the rotation of the rotating body.

BRIEF DESCRIPTION OF THE DRAWINGS

Further characteristics and advantages of the present invention will become apparent from the following detailed description of a particular but not exclusive embodiment thereof, illustrated only by way of non-limitative example in the accompanying drawings, wherein:

FIG. 11 is a view, similar to FIG. 2, of the device in the condition in which the shoe is not associated with said device;

FIGS. 12 and 13 are respectively a top view and a side view of the device in the condition of FIG. 11;

WAYS OF CARRYING OUT THE INVENTION

Figure 1:
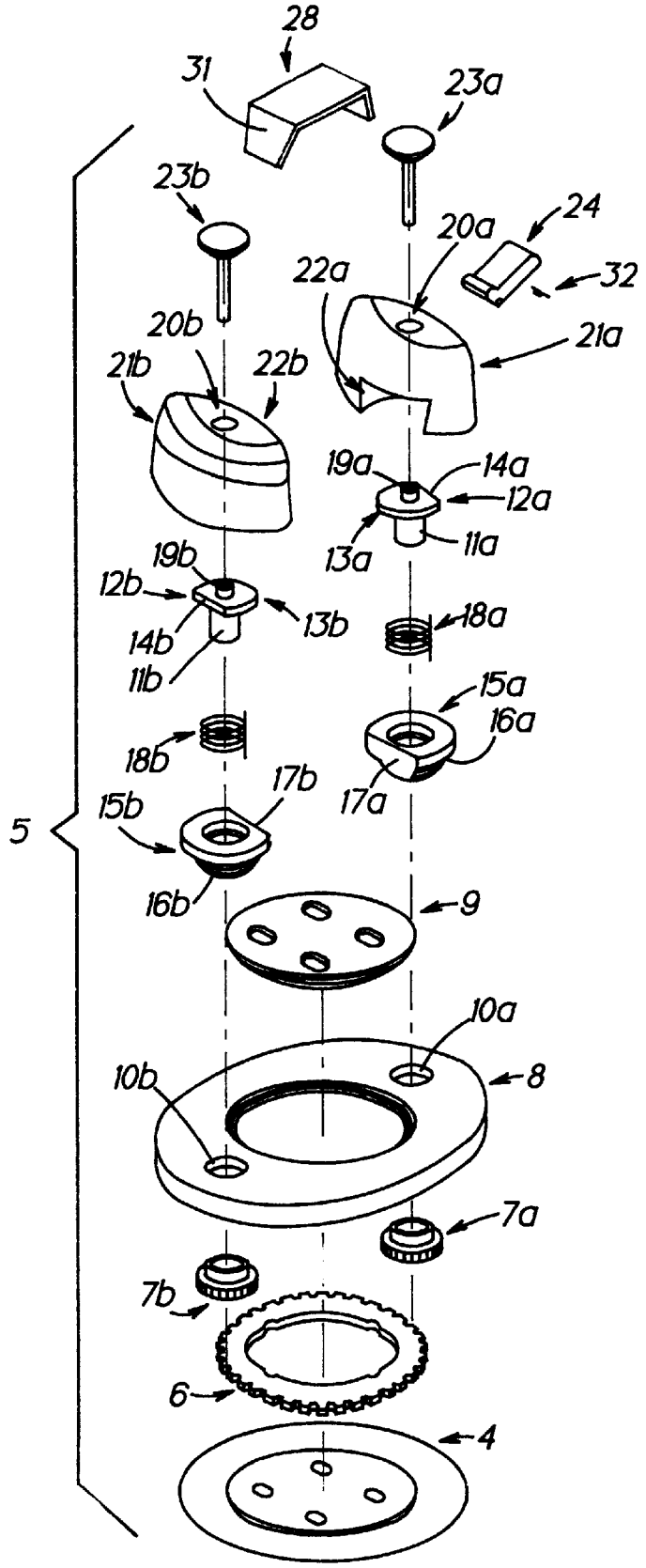
FIG. 1 is a perspective exploded view of some components of the device.

With reference to the above figures, the reference numeral 1 designates a device which can be used particularly for locking shoes, designated by the reference numeral 2, at snowboards, designated by the reference numeral 3.

A plate 4 is rigidly coupled to a board of a snowboard by suitable means such as screws and has a circular plan shape.

The device 1 is constituted by a first rotating body, designated by the reference numeral 5, which is in turn constituted by a ring gear 6 which is rotatably associated at the plate 4 and perimetrically meshes with two complementarily toothed planetary gears 7*a* and 7*b*.

Said planetary gears, together with the ring gear 6, are accommodated inside an annular disk 8 which is rotatably associated with the underlying plate 4 by means of a suitable locking flange 9 which is rigidly coupled to said plate 4.

The annular disk 8 has, at the planetary gears 7*a* and 7*b*, suitable first holes 10*a*, 10*b* which accommodate the stems 11*a*, 11*b* of two second rotating bodies 12*a*, 12*b* which are mushroom-shaped so as to form a head 13*a*, 13*b* which has a circular plan shape and at which there is provided a first cutout portion, designated by the reference numerals 14*a*, 14*b*, which is formed along a chord.

The stems 11*a*, 11*b* of the second rotating bodies are rigidly coupled at the underlying planetary gears 7*a*, 7*b*; engagement and temporary compression means, constituted by two jaws 15*a*, 15*b* which are substantially frustum-shaped and have a circular plan shape, are furthermore associated coaxially with said stems.

A helical tooth, designated by the reference numerals 16*a*, 16*b*, is provided on the lateral surface of the jaws; second cutout portions, designated by the reference numerals 17*a* and 17*b*, are formed on the lateral surface on a plane which passes through a chord.

The jaws 15*a* and 15*b* are furthermore axially perforated for the passage of the stems 11*a*, 11*b* and of suitable flexible elements 18*a*, 18*b*, which are preferably constituted by two cylindrical helical torsion springs and are thus interposed between the heads 13*a*, 13*b* and the annular disk 8 or the planetary gears 7*a*, 7*b*.

Annular raised portions 19*a*, 19*b* protrude from the head 13*a*, 13*b* on the opposite side with respect to the stems 11*a*, 11*b* and can be inserted at complementarily shaped second holes 20*a*, 20*b* which are formed at two shoulders 21*a*, 21*b* which are mutually opposite and on which there are provided suitable first seats 22*a*, 22*b* for partially containing the rotating bodies 12*a*, 12*b* and the jaws 15*a*, 15*b*.

Two pins or screws 23*a*, 23*b* can furthermore be arranged at the second holes 20*a*, 20*b*; their function is to keep the shoulders 21*a*, 21*b*, the jaws 15*a*, 15*b*, the rotating bodies 12*a*, 12*b* and the planetary gears 7*a*, 7*b* packed together.

A lever 24 is transversely and freely pivoted at at least one of said first seats 22*a*, 22*b* and has a first arm 25 which can be accessed from outside the shoulder by the user and a second arm 26 which lies inside the seat and thus inside the shoulder and interacts or not at one of the first cutout portions which are adjacent thereto and are provided in the first rotating bodies 12*a*, 12*b*.

The device is furthermore constituted by grip means which are associated with the sole 27 of the shoe 2; the grip means are constituted by separate components which can be associated with the sole or are obtained directly by shaping the sole in a particular manner.

Figure 6:
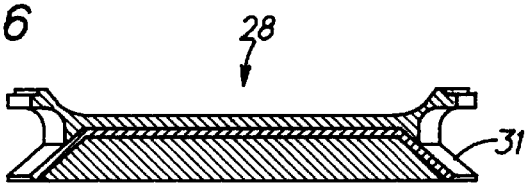
FIG. 6 is a sectional view of the grip means which is associable with the sole of the shoe.
Figure 7:
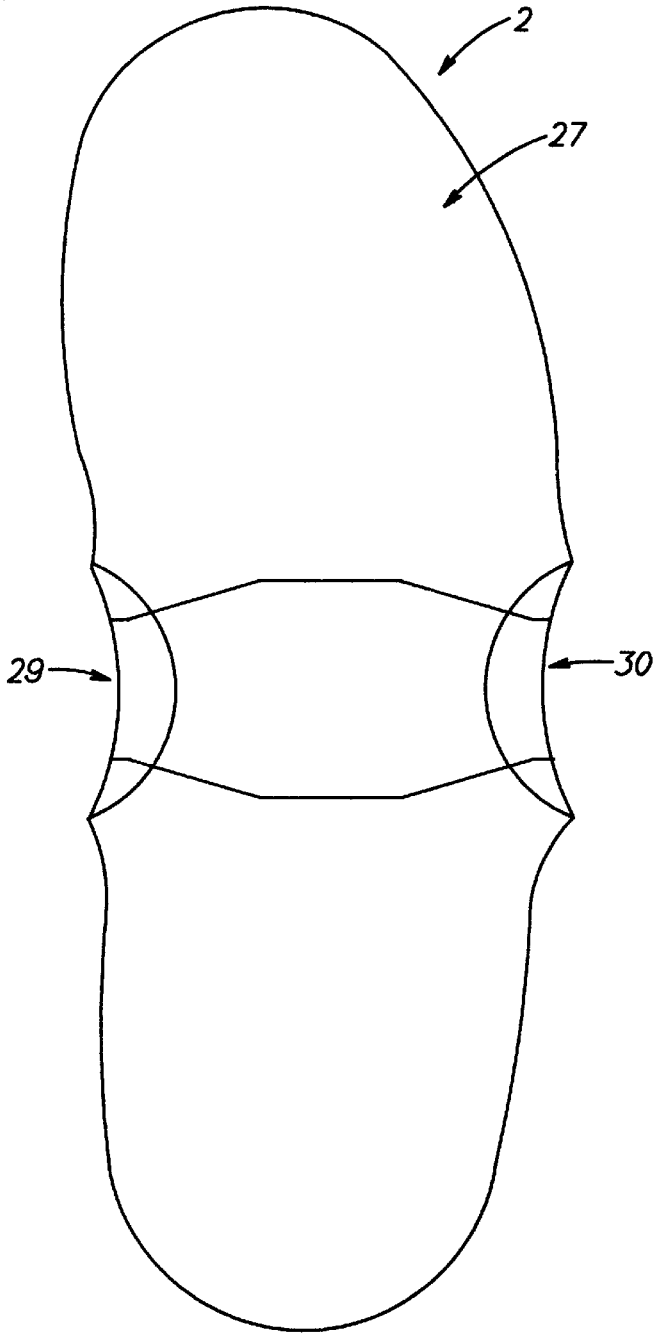
FIG. 7 is a bottom view of the sole of the shoe.
Figure 8:
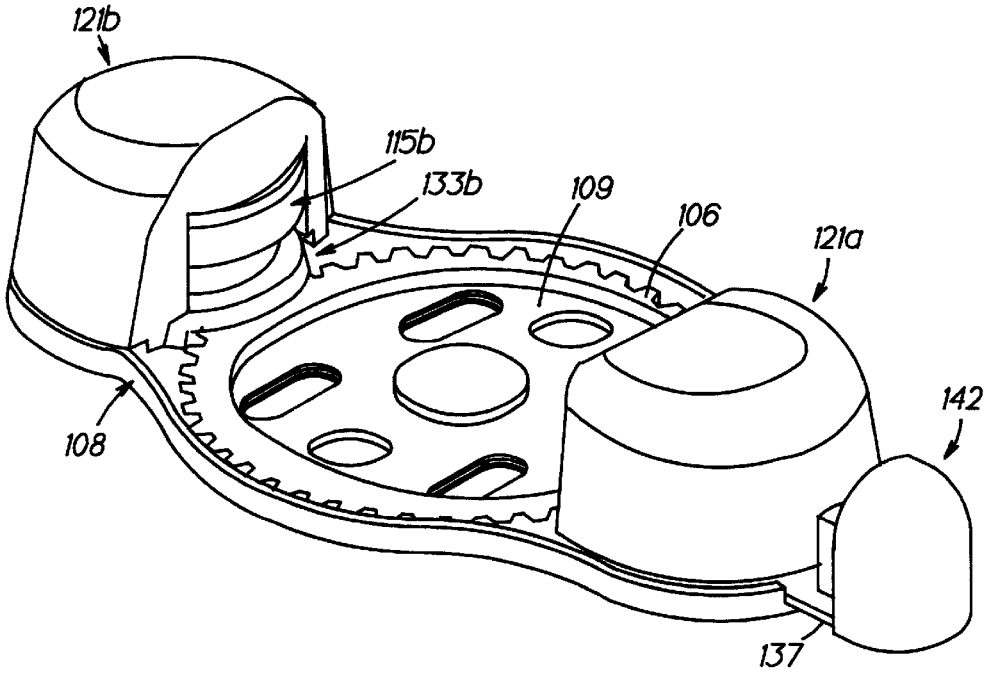
FIG. 8 is a perspective view of a second embodiment of the device.

As shown in FIG. 6, said means are constituted by a plate 28 which is preferably associable at the region of the plantar arch of the sole 27 and has, at the inner side 29 and outer side 30 of the foot, a substantially C-shaped configuration in which a third wing 31, directed towards the device 1, is preferably inclined.

Advantageously, the lever 24 is forced to rotate counterclockwise by a spring 32 which is coaxial to the pivot for pivoting to the shoulder.

Figure 2:
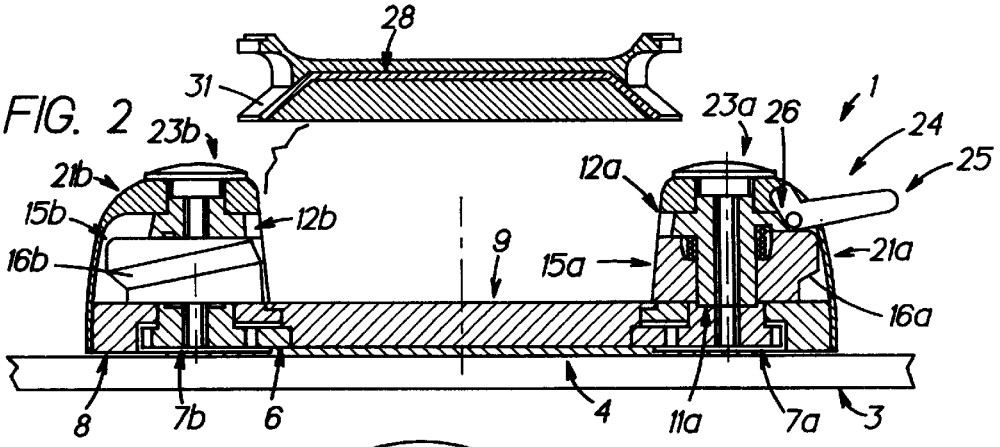
FIG. 2 is a sectional view of the device in the assembled condition, prior to the insertion of the shoe.
Figure 3:
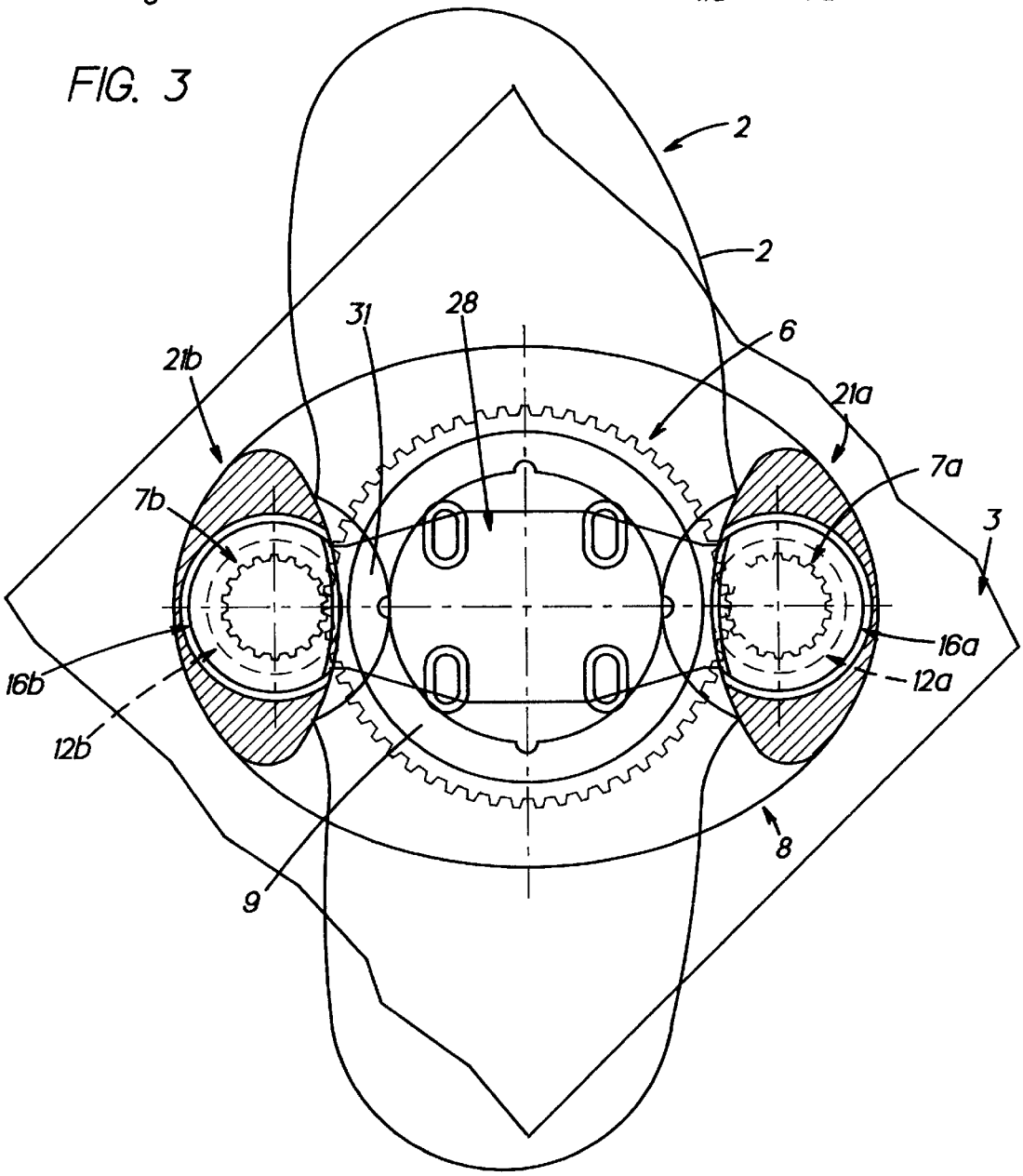
FIG. 3 is a partially sectional top view of the device in the condition of FIG. 2.

Use of the device is thus as follows: in order to engage the shoe it is sufficient for the user to rest the sole 27 and thus the plate 28 at the interspace between the shoulders 21*a*, 21*b*; in this condition, shown in FIG. 2, the lever 24 is not activated and therefore the jaws 15*a*, 15*b* are fully contained within the seats 22*a*, 22*b*.

Thus, once the plate 28 has been rested at the annular disk 8, it is sufficient for the user to slightly rotate said shoe clockwise or counterclockwise: in this way, the entire first rotating body 5 is rotated and, by means of the planetary gears 7*a*, 7*b*, the jaws 15*a*, 15*b* are rotated, making the helical teeth 16*a*, 16*b* interact at the third wing 31 of the plate 28.

Figure 4:
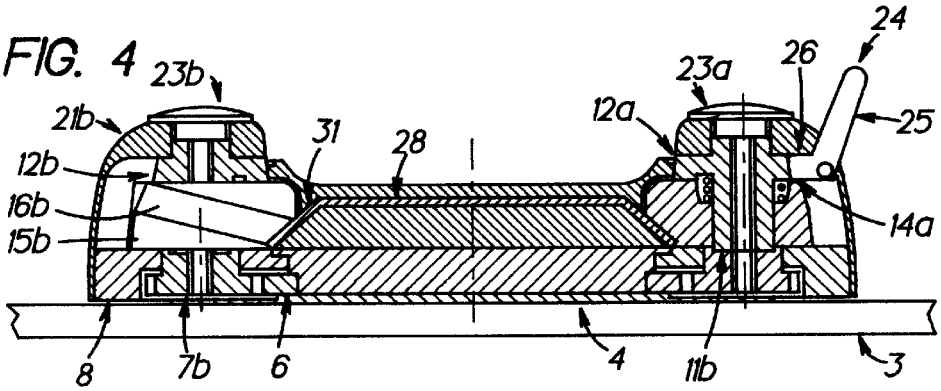
FIG. 4 is a view, similar to FIG. 2, of the device with the grip means, which are glued to the sole of the shoe, associated therewith.
Figure 5:
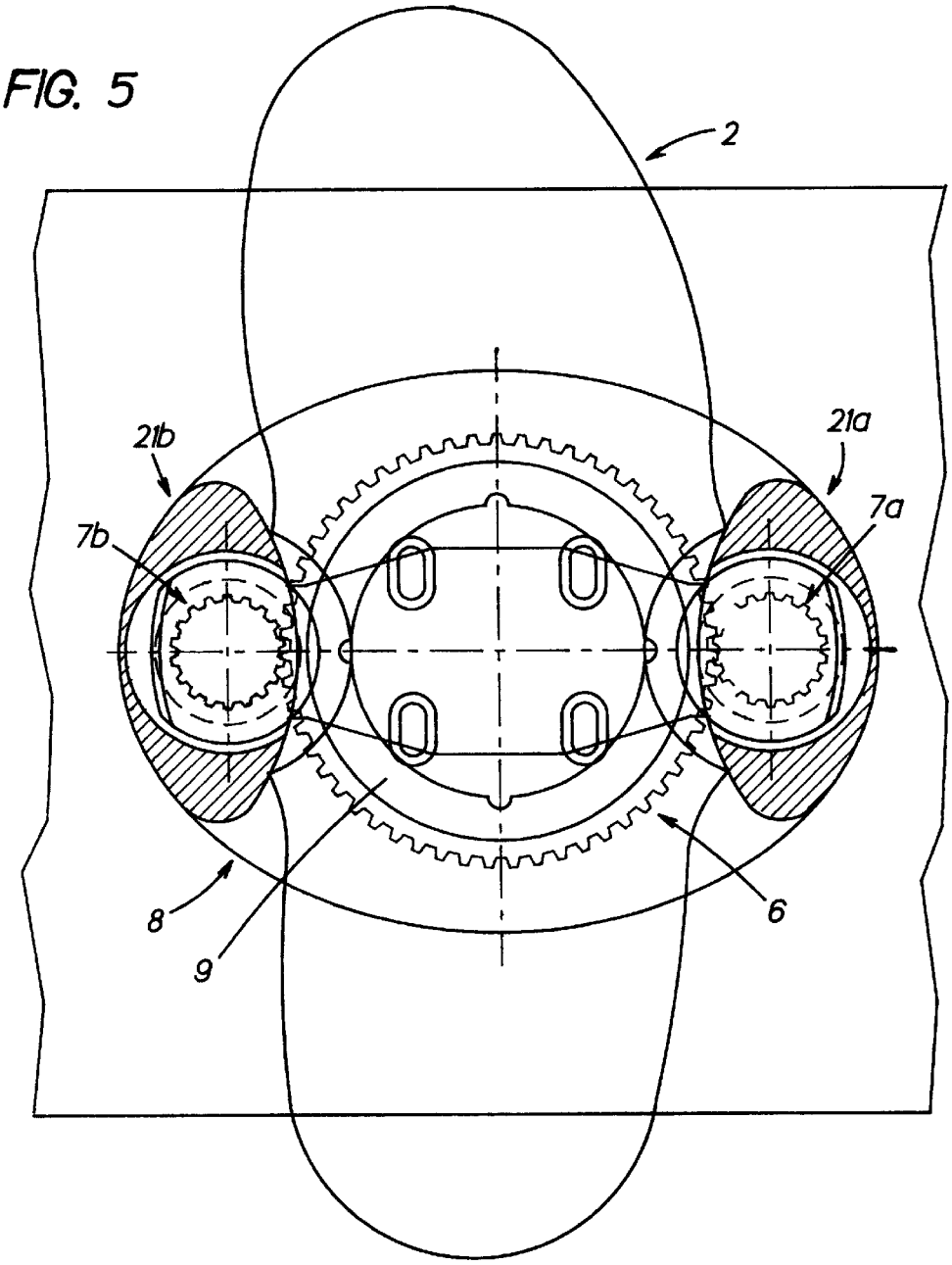
FIG. 5 is a view, similar to FIG. 3, of the condition of FIG. 4.

In this manner, as shown in FIG. 4, the helical teeth 16*a*, 16*b* interact with the third wing 31, applying thereto a downward pressure and thus locking said plate 28 adjacent to the annular disk 8.

By virtue of the reduction between the planetary gears 7*a*, 7*b* and the ring gear 6, once the locking has been achieved, a rotation through approximately 180° of the rotating bodies 12*a*, 12*b* is also achieved so as to place the first cutout portions 14*a*, 14*b* so that they face the second arm 26 of the lever 24.

At this point, the spring 32 rotates the lever 24 counterclockwise and thus causes direct contact between the second arm 26 and one of the first cutout regions 14*a*, 14*b*, so as to lock any further rotation of the rotating body 5, thus in practice locking the position of the shoe with respect to the device.

It has thus been observed that the invention thus conceived has achieved the intended aim and objects, a locking device specific for snowboards having been obtained which is compact, allows optimum transmission of forces from the shoe to the board in order to achieve optimum control of said board, allows to minimize the presence of any snow at the sole of the shoe when it is activated and thus when said shoe is locked, since the continuous pressure applied during the locking step forces the shoe onto the board even if the snow or ice, if present, melts during sports practice.

The device is furthermore compact and allows to rest both the toe and the heel of the shoe at the board by virtue of the configuration of the plate 28 and of the pressure applied thereto towards said board.

The device furthermore allows to achieve optimum, quick and simple engagement and disengagement of the shoe, and this occurs even if these operations are performed on slopes, the shoe being centered in an optimum manner during the insertion step; finally, the pressure applied to the plate 28 allows to eliminate any snow or ice present under the sole; in case of thick layers of snow or ice, the presence of the springs 18*a* and 18*b* allows to compensate for these layers by torsion, thus ensuring the locking of the shoe even if the snow and ice melt over time, since in this situation they tend to elongate.

The device is of course susceptible of numerous modifications and variations, all of which are within the scope of the same inventive concept.

Thus, for example, the remaining figures illustrate a second embodiment, in which the first rotating body 105 is constituted by a ring gear 106 which is rotatably associated inside an annular disk or base 108 which is in turn rotatably associated with the underlying plate 104 by means of a suitable locking flange 109 which is rigidly coupled inside said ring gear 106.

The ring gear perimetrically meshes with two complementarily toothed planetary gears 107*a*, 107*b* which are in turn contained within the annular disk or base 108 and are pivoted thereto at suitable pins or screws 123*a* and 123*b*.

Means for temporary engagement and compression, such as two joints 133*a* and 133*b* shaped like truncated cones and two flexible elements such as two springs 118*a* and 118*b* arranged coaxially to the stem 111*a* and 111*b* of two jaws 115*a* and 115*b* which have a helical protruding tooth 116*a* and 116*b* and are accommodated within shoulders or covers 121*a* and 121*b*, are furthermore pivoted to said pins and clamped in a pack-like configuration.

Figure 9:
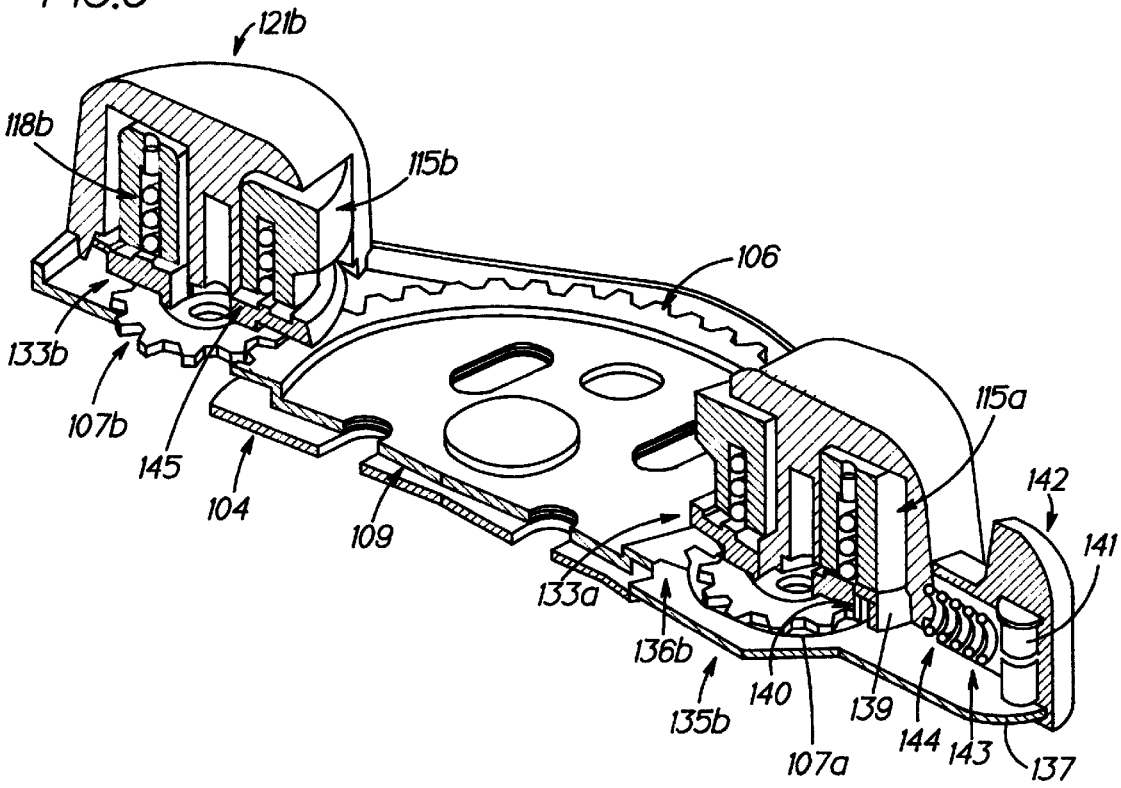
FIG. 9 is a partially sectional view of the device of FIG. 8.
Figure 10:
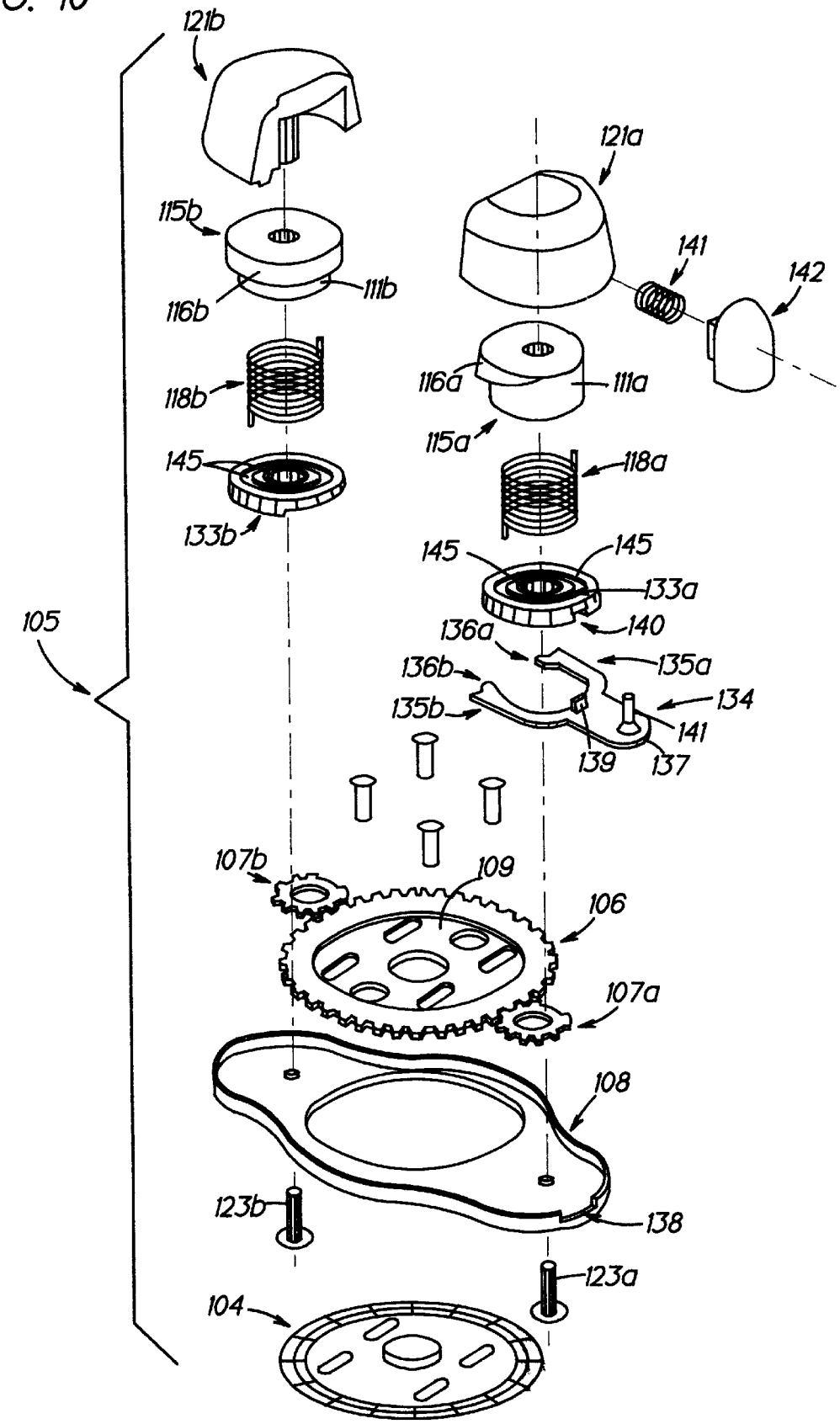
FIG. 10 is a perspective exploded view of the components of the device of FIG. 8.
Figure 16:
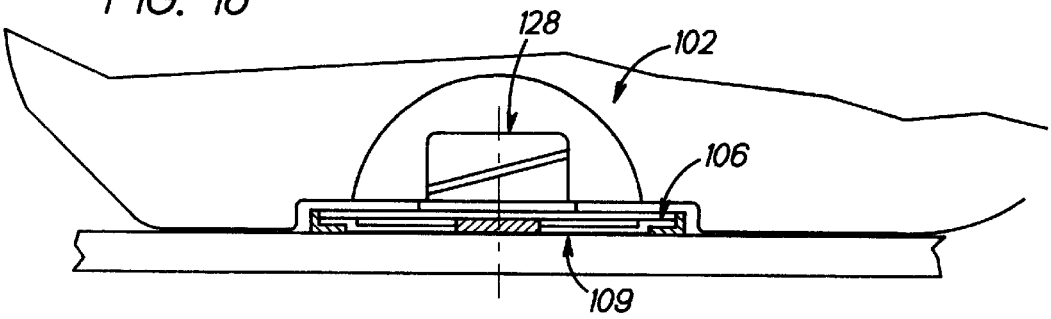
FIGS. 15 and 16 are respectively a top view and a side view of the device in the condition of FIG. 14.
Figure 14:
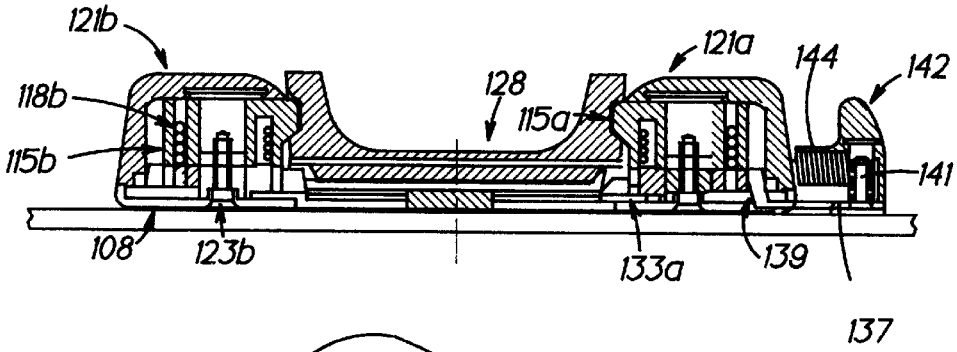
FIG. 14 is a view, similar to FIG. 11, of the device in the condition in which the shoe is associated with the device.
Figure 15:
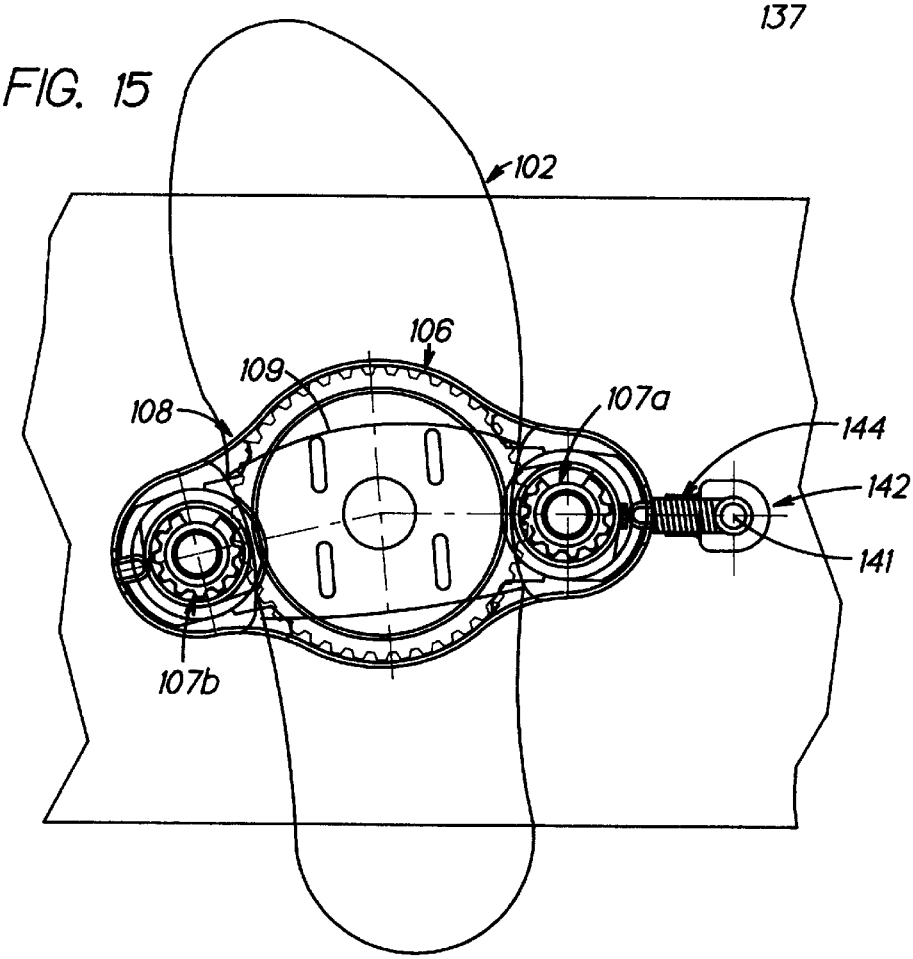
Figure 17:
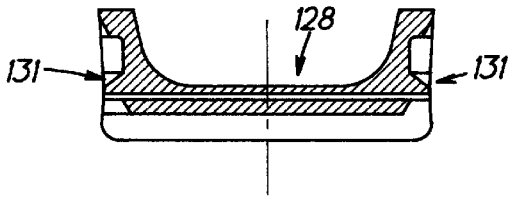
FIG. 17 is a sectional view of the grip means associated with the sole of the shoe.
Figure 19:
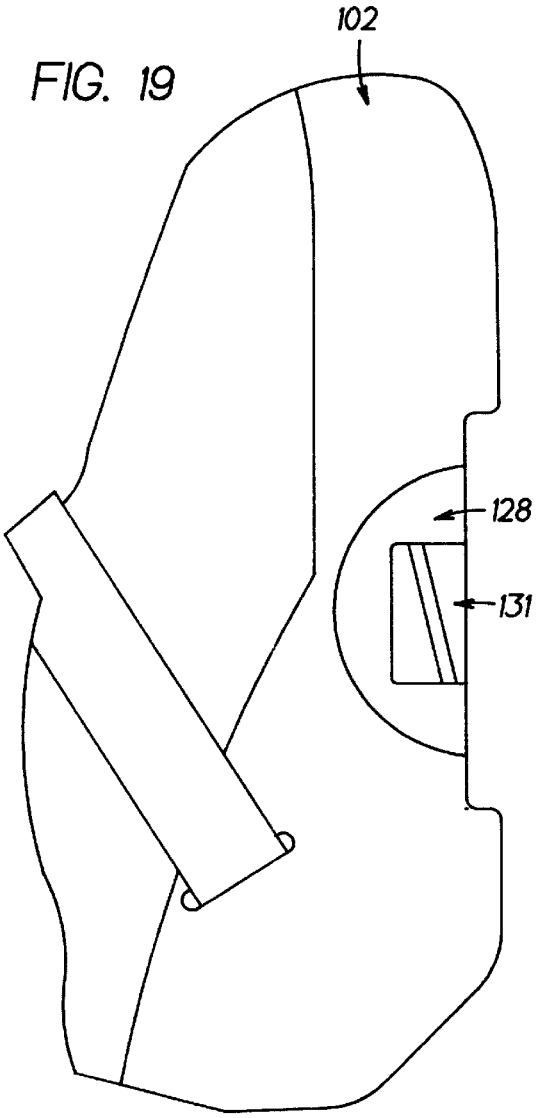
FIGS. 18 and 19 are respectively a plan view and a side view of the shoe with the device applied thereto.
Figure 18:
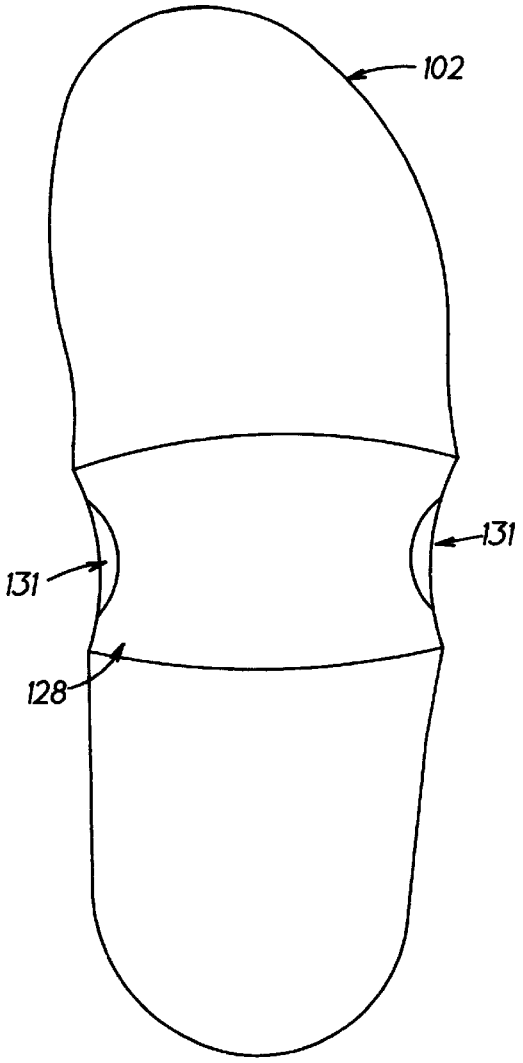

A Y-shaped or fork-shaped element 134 is slidingly interposed between the two joints 133*a* and 133*b* and the annular disk or base 108, as shown in FIG. 9; two raised portions 136*a* and 136*b*, suitable to temporarily mesh with the teeth of the ring gear 106, are provided at the end of the fourth wings 135*a*, 135*b* of said element 134.

A tooth 139, suitable to temporarily engage in a second radial seat 140 formed below the facing joint 133*a*, protrudes at the connection between the fourth wings and the base 137 of the Y-shaped or fork-shaped element 134, which protrudes partially outside the annular disk or base 108 through a suitable opening 138 formed thereon.

The second radial seat 140 is formed so that the tooth 139 affects the seat when the raised portions 136*a* and 136*b* mesh with the ring gear 106; in this condition, the ring gear is rotationally locked and thus the shoe is locked.

A protrusion or pin 141 protrudes from the base 137, on the same side as the tooth 139, and is associated with an L-shaped handle 142 inside which there is a third seat 143 for an additional cylindrical helical compression spring 144 which interacts with the outer lateral surface of the facing shoulder 121*a*; the spring forces the fork to mesh with the ring gear 106, and this operation can be reversed by the user, who can manually shift the handle outward with respect to the device.

Advantageously, on the upper surface of the pair of joints 133*a* and 133*b* there are provided two concentric annular grooves, both designated by the reference numeral 145, for guiding complementarily shaped lower ends of the two jaws 115*a* and 115*b*.

The plate 128 associated below the shoe 102 or formed therewith interacts, by means of the third wing 131, with the helical teeth 116*a*, 116*b*, which lock the shoe as a consequence of the rotation applied thereto.

This solution, too, achieves the intended aim and objects.

The materials and the dimensions that constitute the individual components of the device may of course also be the most pertinent according to specific requirements.

What is claimed is:

1. A locking device for releasably locking a shoe to a snowboard, the locking device comprising a circular plate for being rigidly coupled to a board of a snowboard, a first rotating body which is rotatably associated with said plate about an axis substantially perpendicular to the snowboard and is provided with means for engaging and temporarily compressing complementarily shaped grip means adapted to be associated with a shoe sole, said first rotating body being adapted for actuating said engaging and compressing means into a releasable locked position with said grip means when the shoe is placed on said rotating body and rotates it into the locking position, means being provided for temporarily locking the rotation of said rotating body.

2. A device according to claim 1, wherein said first rotating body is constituted by a ring gear which is rotatably associated at said plate and perimetrically meshes with two complementarily toothed planetary gears which, like said ring gear, are accommodated in an annular disk or base which is rotatably associated with said plate by means of a locking flange which is rigidly coupled to said plate.

3. A device according to claim 2, wherein said annular disk has, at said planetary gears, first holes which accommodate the stems of two second rotating bodies which are mushroom-shaped, so as to form a head with a circular plan shape at which there is provided a first cutout portion formed along a chord.

4. A device according to claim 3, wherein said stems of said second rotating bodies are rigidly coupled at said planetary gears, temporary compression and engagement means being furthermore associated coaxially to said stems and being constituted by two jaws which are preferably shaped substantially like a truncated cone with a circular plan shape.

5. A device according to claim 4, wherein a helical tooth is formed on the lateral surface of said jaws, second cutout regions being formed on said lateral surface on a plane which passes through a chord.

6. A device according to claim 5, wherein said jaws are axially perforated for the passage of said stems and of flexible elements which are constituted by two first cylindrical helical torsion springs interposed between said head and said annular disk or planetary gears.

7. A device according to claim 6, wherein annular raised portions protrude from said head, on the opposite side with respect to said stems, and can be inserted at complementarily shaped second holes formed at two covers or shoulders which are mutually opposite and on which there are provided suitable first seats for partially containing said first rotating bodies and said jaws.

8. A device according to claim 7, wherein two pins or screws can be arranged at said second holes, said pins keeping said shoulders, said jaws, said first rotating bodies and said planetary gears packed together.

9. A device according to claim 8, wherein a lever is transversely and freely pivoted at at least one of said first seats and has a first arm which can be accessed by the user from outside said shoulder and a second arm which lies inside said seat and inside said shoulder and can interact or not at one of said first cutout regions which are adjacent thereto and are present in said first rotating bodies.

10. A device according to claim 9, comprising grip means which are associated with said sole of said shoe, said grip means being constituted by separate components which can be associated with said sole or are obtained directly by shaping said sole, said means being constituted by a plate which is associable at the plantar arch region of said sole and has, at the inner and outer sides of the foot, a substantially C-shaped configuration in which a third wing is directed towards said device and is inclined.

11. A device according to claim 10, wherein said lever is forced to rotate counterclockwise by a spring which is coaxial to the pivot for pivoting to said shoulder, forcing said third wing towards said annular element.

12. A device according to claim 2, wherein said annular disk is rotatably associated with said plate by means of a locking flange which is internally rigidly coupled to said ring gear, said ring gear meshing perimetrically with two complementarily toothed planetary gears which are in turn contained within said annular disk and are pivoted thereto at pins or screws.

13. A device according to claim 2, wherein said annular disk has a box-like shape for containing some of the components of said first rotating body.

14. A device according to claim 2, wherein said ring gear is rotatably associated inside said annular disk which is in turn rotatably associated with said plate by means of a locking flange which is internally rigidly coupled to said ring gear, said ring gear meshing perimetrically with two complementarily toothed planetary gears which are in turn contained within said annular disk and are pivoted thereto at suitable pins or screws.

15. A device according to claim 14, wherein temporary engagement and compression means, constituted by two joints shaped like truncated cones and two flexible elements such as two springs arranged coaxially to stems of two jaws provided with a helical protruding tooth, are pivoted and clamped in a pack-like arrangement to said pivots or screws, said two jaws being accommodated within shoulders or covers.

16. A device according to claim 15, wherein a Y-shaped element or fork is slidingly interposed between said two joints and said annular disk, two raised portions being provided at the ends of the fourth wings of said Y-shaped element or fork and being suitable to temporarily mesh with the teeth of said toothed ring.

17. A device according to claim 16, wherein a tooth protrudes at the connection between said fourth wings and the base of said Y-shaped or fork-shaped element that protrudes partially outside said annular disk through an opening formed thereon, said tooth being suitable to temporarily engage within a second radial seat formed below one of said two joints.

18. A device according to claim 17, wherein said second radial seat is formed so that said tooth affects it when said raised portions mesh with said ring gear, which is accordingly rotationally locked and in turn locks said shoe.

19. A device according to claim 18, wherein a protrusion or pin protrudes from said base on the same side as said tooth and is associated with an L-shaped handle in which there is provided a third seat for an additional cylindrical helical compression spring which interacts with the outer lateral surface of one of said shoulders, said additional spring being suitable to force said fork to mesh with said ring gear, this action being reversible by the user, who can manually shift said handle outward with respect to said device.

20. A device according to claim 19, wherein two concentric annular guiding grooves for complementarily shaped lower ends of said two jaws are formed on the upper surface of said two joints.

* * * * *